US006817399B2

(12) United States Patent
Berman et al.

(10) Patent No.: US 6,817,399 B2
(45) **Date of Patent: *Nov. 16, 2004**

(54) APPARATUS AND METHOD FOR ASSEMBLING SHEET MATERIAL MOUNTING DEVICE COMPONENTS

(75) Inventors: Joel Berman, Hewlett, NY (US); Vincent J. Brown, deceased, late of Valley Stream, NY (US); by Helen Brown, legal representative, Valley Stream, NY (US); Viktor Erlikh, Brooklyn, NY (US); Dimitry Gomelsky, New York, NY (US)

(73) Assignee: Mechoshade Systems, Inc., Long Island City, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/153,544

(22) Filed: May 22, 2002

(65) Prior Publication Data

US 2002/0190175 A1 Dec. 19, 2002

Related U.S. Application Data

(63) Continuation-in-part of application No. 09/408,228, filed on Sep. 29, 1999, now Pat. No. 6,402,110.

(51) Int. Cl.[7] ..... E06B 3/48
(52) U.S. Cl. ..... 160/84.04; 160/170 R
(58) Field of Search ..... 160/170 R, 171 R, 160/84.01, 84.04, 84.05, 84.06, 405

(56) References Cited

U.S. PATENT DOCUMENTS

| | | | | |
|---|---|---|---|---|
| 1,321,800 A | | 11/1919 | Andress et al. | |
| 4,107,826 A | | 8/1978 | Tysdal | |
| 4,542,602 A | | 9/1985 | Hoverson | |
| 4,694,545 A | | 9/1987 | Dernis | |
| 5,133,399 A | * | 7/1992 | Hiller et al. | 160/171 R |
| 5,207,256 A | | 5/1993 | Kraeutler | |
| 5,273,096 A | | 12/1993 | Thomsen et al. | |
| 5,328,113 A | | 7/1994 | Villette | |
| 5,566,735 A | | 10/1996 | Jelic | |
| 5,690,156 A | | 11/1997 | Ruggles | |
| 5,799,715 A | | 9/1998 | Biro et al. | |
| 5,862,850 A | | 1/1999 | Yang | |
| 6,164,428 A | | 12/2000 | Berman et al. | |
| 6,402,110 B1 | * | 6/2002 | Berman et al. | 248/316.2 |
| 6,588,480 B2 | * | 7/2003 | Anderson | 160/170 R |
| 6,622,769 B2 | * | 9/2003 | Judkins | 160/84.05 |

FOREIGN PATENT DOCUMENTS

| | | |
|---|---|---|
| EP | 0 451 912 A1 | 10/1991 |
| WO | WO 98/20226 | 5/1998 |

* cited by examiner

*Primary Examiner*—David Purol
(74) *Attorney, Agent, or Firm*—Snell & Wilmer L.L.P.

(57) ABSTRACT

The present invention provides a sheet material mounting system having a lifting sleeve, a center support bracket, an engaging rod and two or more lifting cords. The outer circumference of a left portion of the lifting sleeve is greater than the outer portion of a right portion of the lifting sleeve. The outer surface of the lifting sleeve forms a smooth concave surface. The lifting sleeve is configured to support a winding tube during operation of the mounting system. The lifting sleeve abuts against the center support bracket. The center support bracket includes guides for directing the lift cords onto the lifting sleeve. The lift cords are attached to a bottom leveling system for ensuring that the shade material remains parallel during system operation. As the shade is raised, the lifting cords wind around the outer surface of the lifting sleeve. The center support guides ensure that the lifting cords contact the lifting cone at an angle ensuring that the cords are wound (and unwound) unstacked during mounting system operation. The cords are wound in unison and the shade remains parallel during raising and lowering.

4 Claims, 9 Drawing Sheets

APPARATUS AND METHOD FOR ASSEMBLING SHEET MATERIAL MOUNTING DEVICE COMPONENTS

CROSS REFERENCE TO RELATED APPLICATION

The present application is a continuation-in-part of U.S. patent application Ser. No. 09/408,228, filed Sep. 29, 1999 now U.S. Pat. No. 6,402,110.

FIELD OF THE INVENTION

The present invention relates generally to an apparatus and method for mounting sheet material to a support structure and, more particularly, to an apparatus and method for assembling the components of a window covering system, such as a Roman shade window covering system.

BACKGROUND OF THE INVENTION

The prior art contains various devices for mounting, lifting, and folding flexible sheet material in association with blinds, curtains, draperies, and other window coverings. Some of these window shade devices include guide cables and lift cords in conjunction with a fabric-gripping device. These cables/cords are typically threaded through rings sewn to the shade fabric. Alternatively, the cables/cords are threaded through apertures in the fabric pleats, wherein the pleats may be formed or stiffened with slats. The lattice formed by the attachment of the shade fabric to these guide cables and lift cords constitutes a mobile support structure which allows the shade to travel between raised and lowered positions.

Roman shades are a particular type of window covering which incorporates a mobile support structure such as a lattice for gathering sheet fabric into substantially horizontal folds. One example of the construction of a contemporary Roman shade is a cloth fabric hanging from a head rail, with a lower end having weights at predetermined lateral intervals. Drawing up a lift cord can raise this type of Roman shade such that large, loose folds in the fabric are formed at approximately equal vertical distances to provide a neatly pleated aesthetic appearance. A common configuration for connecting the cord to the shade is to sew at least two sets of rings or connectors in vertical lines along the back of the fabric material as shown in U.S. Pat. No. 1,321,800 entitled CURTAIN HANGER issued to Andress, et al. on Nov. 18, 1919. In this type of Roman shade, a lift cord passes from a head rail through each set of rings and is then either fastened to the bottom edge of the fabric or wrapped around the bottom edge of the fabric and returned up the front face of the shade to the head rail. Alternatively, each set of rings or connectors is sewn to the sheet fabric and attached to a lift cord at predetermined vertical intervals. As the shade travels through raised positions, the interval between the connectors may be reduced.

However, due to the extensive time and labor to sew connectors to the back of the sheet material of a Roman shade, the art has developed other methods and devices to connect sheet fabric to a mobile support structure. In the shade system disclosed in U.S. Pat. No. 4,694,545 entitled ATTACHMENT OF RINGS WITHOUT SEWING issued to Dernis on Sep. 22, 1987, a set of U-shaped filaments is inserted through the fabric from the front face. The ends of each filament are gathered in a tube, bent over the end of the tube and held in place by a sleeve that fits over the tube.

Another alternative for attachment includes one or more horizontal ribs to provide support and to maintain spacing between the cords which are oriented vertically across the back of the fabric. For example, in U.S. Pat. No. 5,207,256 entitled SAFETY DEVICE FOR A RAISABLE CURTAIN DOOR issued to Kraeutler on May 4, 1993, the ribs are placed in vertically spaced, transverse pockets in the sheet material. However, in this system, the pockets must be sewn into the sheet material, thereby substantially adding to the time, effort, and expense of manufacture.

U.S. Pat. No. 5,273,096, entitled APPARATUS FOR GRIPPING SHEET FABRIC issued to Thomsen et al. on Dec. 28, 1993, discloses a tubular member having a longitudinal opening which receives the fabric and a rod, thereby gripping the fabric between the member and the rod. The backsides of the tubular members each include loops through which the lift cords pass. However, as shown in FIG. 10, if this system is used on a Roman shade for a large window, the combined weight of the tubular member and the rod will often cause tilting of the mounting device, thereby adding substantial friction to the lift cord and making it more difficult to raise the shade. More particularly, the fabric mounting device found in Thomsen et al. and other Roman shade systems employ designs wherein the center of gravity of the fabric mounting device causes the device to tilt asymmetrically as the shade is raised, distorting the fabric being held and thereby adding friction to the lift cord. Thus, the size of a Roman shade is often limited by the friction incident upon the lift cord caused by the tilting of one or more of the rings, connectors, loops, or spacers used to mount the fabric to the lift cord.

Several prior art methods purport to provide a system for uniformly raising a window shade, such as a Roman shade, thereby eliminating the tilting affect and increased friction on the lifting cords. One such prior art method, uses an angled off-set of a pair of lift cords to ensure that the lift cords may be raised without substantial cord overlapping. In particular, the method involves attaching the cord pair to a leveling rod positioned at the shade bottom. The cords are affixed equidistant from the opposing ends of the leveling rod. That is, when measured from the right and left borders of the shade, the left lift cord is affixed to the leveling rod at a distance, X, when measured from the left border, and the right lift cord is affixed to the leveling rod at a distance X, when measured from the right border. The tops of the cords are attached to a winding tube positioned at the upper most portion of the shade material. In this instance, the left lift cord is affixed at a distance, X–Y, from the left border, and the right cord is affixed at a distance, X–Y, from the right border. Thus, the line drawn by the left (and alternatively, the right) cord forms an angle with the winding tube. In this configuration, the prior art system purports to provide a method for raising the shade uniformly, since the cords will not be permitted to roll over each other during the raising and lowering of the shade. However, this method is not suitable for shades which require the lifting cords to be perpendicular to the lift tube during operation.

Another prior art system for lifting a shade with two lift cords involves using a traversing lifting tube in combination with lift cords which move relatively perpendicular to the lifting tube during operation. In this instance, at the top and bottom of the shade material, the left lift cord is affixed equidistant from left border, and the right lift cord is affixed equidistant from the right border. The lift cords are preventing from rolling over each other by the traversing motion of the winding tube. That is, as the winding tube is raised (or lowered) during operation of the system, the winding rod not only rotates to lift the cords, but also traverses in a left (or right) horizontal direction to ensure that the lift cords do not overlap during the winding process. When unwinding, the lift tube traverses in the opposite direction. However, this method is not suitable for shades which operate in a confined area. In particular, additional room is need for the traversal of the winding tube, preventing the use of this system within a narrow shade mounting area.

Yet another prior art system uses a segmented lift cone design in its winding mechanism. U.S. Pat. No. 5,328,113 issued Jul. 12, 1994 to Villette, and assigned to Somfy is exemplary of this design. The circumference of the outer lift cone is greater at the point where the lift cone is nearest the wall, and becomes narrower in the direction toward the shade material. Key to this design is the segmented characteristic of the lift cone. That is, the lift cone can be seen as multiple cones where the portion of each cone with the greatest outer circumference is joined to the portion of the preceding cone with the least outer circumference. In this configuration, where the cones are joined, there is a pronounced drop-off from the first cone to the subsequent cone. The drop-off purports to reduce the friction on the lift cords as the cords are wound, since the cords become wound around progressively narrower cone structures.

However, the Somfy cone poses some challenges. For example, the cone is expensive to produce since the overall structure involves joining several facets into a single cone structure. Further, the design of the cone structure with particular drop offs from cone to cone provides room for error. That is, where the cones are joined at an improper angle, the cone system would be deviated from its original design, and, thus, made less effective.

A need exists for a lightweight, sheet-material gripping apparatus which can be quickly assembled by the manufacturer and which includes both lightweight and inexpensive spacers that can be connected to the sheet material without sewing. Moreover, the gripping apparatus components should reduce the lift cord friction which often increases asymmetric tilting of the sheet-material connectors as the apparatus is raised. Additionally, there is a need for an apparatus and method for easily and rapidly assembling tightly fitted components of a sheet material gripping apparatus such that, once assembled, the components of each sheet material gripping apparatus are capable of maintaining vertical alignment with respect to other sheet material gripping apparatus comprised by the window covering system. Moreover, there is a need for an apparatus and method for easily adjusting and re-aligning assembled components of a sheet material gripping apparatus. Further still, there is a need for a sheet material winding structure which is inexpensive and which enables the operator to lift two or more lift cords while keeping the sheet material absolutely uniform as the sheet material is raised an lowered.

SUMMARY OF THE INVENTION

The present invention provides a sheet material mounting device having two channels, namely, a mounting channel for receivably engaging a rod for gripping the sheet material and a spacer channel for receivably engaging a spacer support configured to engage a lift cord and, optionally, a spacer cord. The spacer channel may be positioned above the mounting channel such that the center of gravity of the mounting device is located above the center of the mounting channel, thereby reducing asymmetric tilt of the sheet material engaged by the mounting channel and reducing function against the lift cord. Alternatively, the mounting channel may be positioned above the spacer channel. The mounting channel and the spacer channel are preferably both C-shaped, and each channel has an opening which faces in a direction opposite the direction faced by the opening of the other channel. Thus, a side view of the mounting device may resemble either an "S" or a reverse "S." The lifting cord is attached to a cylindrical lifting sleeve for use in raising and lowering the shade sheet material. The outer surface of the cylindrical lifting sleeve is concave such that the arc formed by the outer surface represents a circular segment. As the sheet material is raised, the cord wraps around the lifting sleeve and traverses the sleeve from the distal end to the proximal end, facilitating the winding of the cord while minimizing or eliminating any cord stacking or overlap. This, in turn, provides a uniform and level lifting means of the fabric bands, with two or more lift sleeve and cord assemblies.

In accordance with another aspect of the invention, there is provided an apparatus and method for assembling the components of a sheet-material mounting device, such that the assembled components of each sheet material mounting device are capable of maintaining vertical alignment with respect to every other sheet material mounting device comprised by the window covering system. Moreover, there is provided an apparatus and method for adjusting and re-aligning assembled components of a sheet material gripping apparatus.

BRIEF DESCRIPTION OF THE DRAWINGS

The features and advantages of the present invention reside in the details of construction and operation as more fully depicted, described, and claimed below, with particular reference to the accompanying drawings, wherein like numerals refer to like parts throughout, and wherein:

DETAILED DESCRIPTION OF EXEMPLARY EMBODIMENTS

The following detailed description of exemplary embodiments of the present invention makes reference to the accompanying drawings, which form a part hereof and in which are shown, by way of illustration, exemplary embodiments in which the invention may be practiced. These exemplary embodiments are described in sufficient detail to enable those skilled in the art to practice the invention, and it should be understood that other embodiments may be utilized and that logical and mechanical changes may be made without departing from the spirit and scope of the present invention. Thus, the following detailed description is presented for purposes of illustration only and not of limitation, and the scope of the present invention is defined solely by the appended claims.

The present invention preferably includes an apparatus and method for reducing a shade clamp's tilt and reducing the excess friction between a shade clamp (or channel guide) and a lift cord. One skilled in the art will appreciate that the shade clamp may be any device or combination of devices suitably configured to hold sheet material. For example, any clamp, clip, ring, fastener, mechanical device, electrical device, magnetic device, VELCRO™ device and/or the like. Moreover, the shade clamp is comprised of any suitable material which provides sufficient characteristics for holding the sheet material, such as, for example, any type or combination of plastic, metal, rubber, wood, magnet, textile, glass and/or the like. Further, one skilled in the art will appreciate that the sheet material is any material capable of being held by shade clamp, such as, for example, any type or combination of cloth, textile, roman shade, pleated roman shade, wood, metal, animal skin, plastic, mesh, weave, and/or the like. In an exemplary embodiment, the sheet material is a piece of material in the form of a roman shade.

Figure 15C:
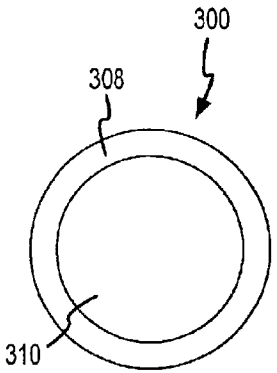
FIGS. 15A-D illustrate side, front and rear perspective views of the lifting sleeve in accordance with an exemplary embodiment of the present invention.
Figure 15D:
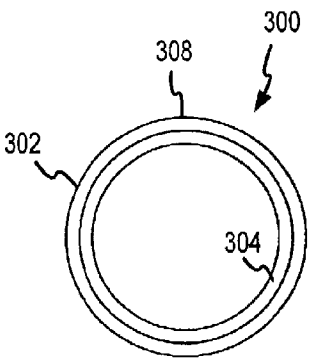
Figure 16:
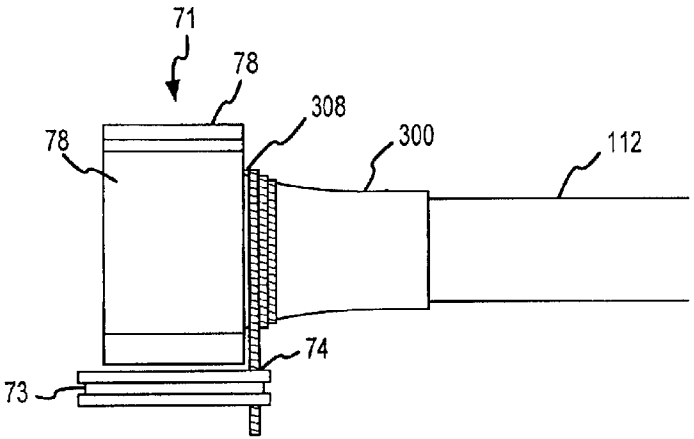
FIG. 16 illustrates a side view of the center support assembly and the lifting sleeve in accordance with an exemplary embodiment of the present invention.

A suitable support structure is any structure capable of supporting the shade clamp and material, such as a headrail, cord, and/or spacers. With momentary reference to FIGS. 13, 15A-C, and 16 an exemplary embodiment of a shade system in accordance with the present invention is shown. The exemplary shade system preferably includes shade clamp 1 (only one shown), housing 90, center support bracket 71, lift tube 112, facie 110, and other components of the system which will be described in more detail below. As depicted in FIG. 16, the exemplary shade system may further include a lifting sleeve 300 (shown in FIGS. 15A-C). The lifting sleeve 300 may surround the lift tube 112 to facilitate collecting and releasing of the lifting cord 65. The present system may be used in conjunction with any shade operator device, such as a wrap spring shade operator as in "Wrap Spring Shade Operator" with inventors Joel Berman, Vincent J. Brown, Victor Erlikh and John Wilk filed on Aug. 23, 1999 having U.S. Ser. No. 09/379,065, the entire application is incorporated herein by reference.

Figure 1:
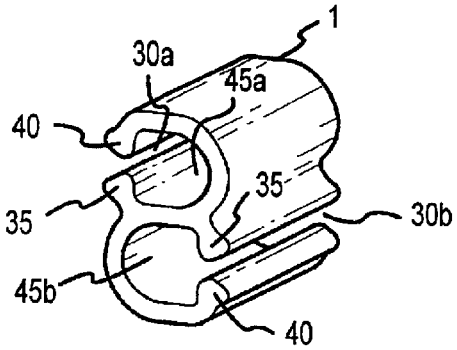
FIG. 1 is a three-quarter-perspective view of an exemplary shade clamp according to one embodiment of the present invention.

Referring now to FIG. 1, in accordance with one exemplary embodiment, a shade clamp 1 grips and mounts flexible sheet material 60 to a hanging support structure. The S-shaped shade clamp 1 is preferably rotationally symmetric about the central axis of clamp 1 and has opposed channels 45*a*, 45*b*, wherein mounting channel 45*b* reciprocally receives a welting of sheet material 60 and spacer channel 45*a* receives a spacer support 5, shown in FIG. 4. The clamp 1 preferably includes interior retaining lips 35*a*, 35*b* and peripheral retaining lips 40*a*, 40*b* wherein an interior and peripheral retaining lip pair secures the welting of sheet material 60 or the spacer support 5 within opposed channels 45*a*, 45*b* by restricting the exit path. Each interior lip 35 and peripheral lip 40 pair defines opposed lateral openings 30*a*, 30*b* which provide access to opposed channels 45*a*, 45*b*, respectively. The welting of sheet material 60 is releasably nested in the mounting channel 45*b* with a positive pressure against the inside surface of the channel requiring no further tension or clamping. The interior lip 35*b* and peripheral lip 40*b* of the mounting channel lateral opening 30*b* serve the dual purpose of preventing random release of the secured welting and providing for the neat pinching of the exterior sheet material so as to obscure the view of rod 10, shown in FIG. 3, within the mounting channel 45*b*. In a preferred embodiment, the welting of sheet material 60 and the spacer support 5 are removably held within opposing channels 45*a*, 45*b* by interior lips 35*a*, 35*b* and peripheral lips 40*a*, 40*b*, respectively; however, those skilled in the art will also recognize various other means and methods that may be alternatively or conjunctively used within the scope of the present invention, such as any device or combination of devices suitably configured to restrict the exit path of material 60 or spacer support 5. For example, the device or combination of devices may include a release pin, clasp, snaps, adhesive and/or the like.

Figure 2A:
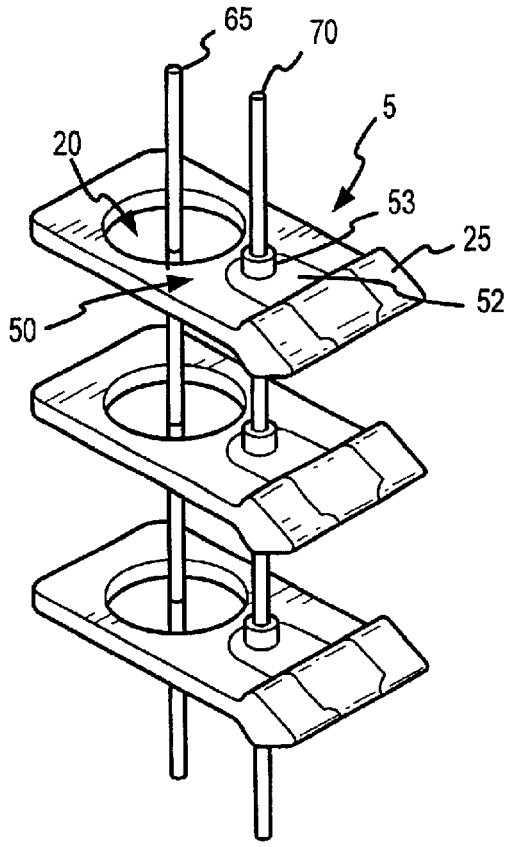
FIG. 2A is a perspective view of an exemplary spacer according to one embodiment of the present invention.
Figure 2B:
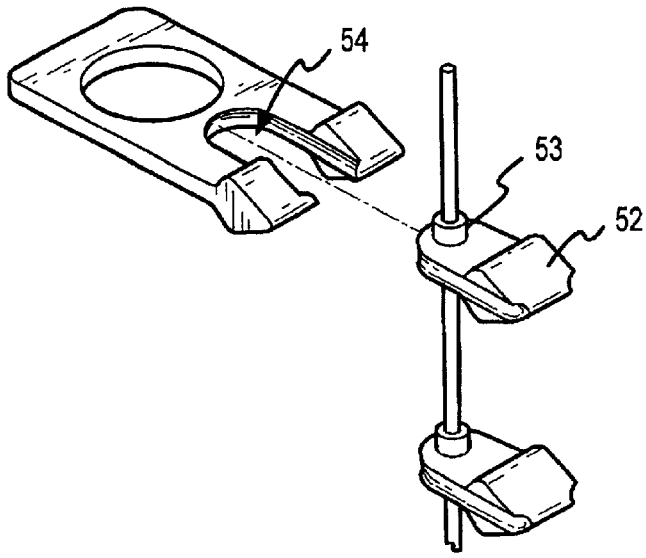
FIG. 2B is a perspective view of an exemplary spacer with the lug portion removed according to one embodiment of the present invention.

As shown in FIGS. 2A and 2B, spacer support 5 is configured for guiding the lift/guide cord 65, optionally attaching to spacer cord 70, and being receivably engaged by spacer channel 45*a*. As best shown in FIG. 2A, the spacer support 5 has an enlarged cylindrical end 25 which tapers down on its outside edge, thereby forming an arrowhead like configuration. Cylindrical end 25 is configured for nesting within spacer channel 45*a* between the inside surface of spacer channel 45*a*, the interior channel lip 35*a* and the peripheral channel lip 40*a*. Those skilled in the art will also recognize various other means and shapes that may be alternatively or conjunctively used which are considered as being within the scope of the present invention, such as any device or combination of devices suitably configured to engage the spacer channel 45*a*. For example, such a device or combination of devices may include a pin, rod, clasp, adhesive, and/or the like. Moreover, spacer support 5 can be integral with shade clamp 1 as a single-piece construction. Spacer support 5 itself can also be of single piece construction. In a preferred embodiment, spacer support 5 is clear rigid PVC material with UV protection; however, any suitable material such as plastic, metal, wood and/or the like is within the scope of the present invention.

Figure 4:
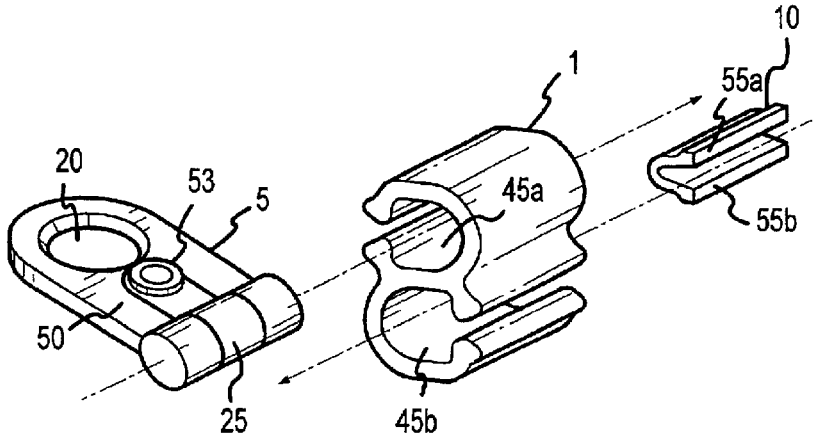
FIG. 4 is a three-quarter perspective, exploded view of an exemplary sheet-material mounting apparatus depicting the positional relationship of the component parts according to one embodiment of the present invention.

With reference to FIGS. 2A and 4, a planar flange 50 is attached to the longitudinal surface of cylindrical end 25, such that flange 50, when spacer support 5 is inserted into spacer channel 45*a*, protrudes outwardly from the channel opening 30*a*. In a preferred embodiment, spacer flange 50 includes an aperture 20 which receives lift cord 65 therethrough. The lift cord aperture 20 is positioned on the spacer flange 50 at a predetermined distance away from cylindrical end 25. In a preferred embodiment, spacer support 5 is molded around spacer cord 70, thereby providing a secure attachment between cord 70 and spacer support 5. In a particularly preferred embodiment, spacer support 5 includes a cylindrical projection 53 which extends above and below spacer support 5. In this embodiment, cylindrical projection 53 is also molded around spacer cord 70, thereby increasing the support by spacer support 5 around spacer cord 70. Cylindrical projection 53 may be any suitable material, may project above and/or below spacer support 5, may be molded as a single unit with spacer support 5, may be a separate component (such as a dowel, washer, etc.), and may be located anywhere on spacer support 5. One skilled in the art will appreciate that the present system can include more than one lift cord 65 or more than one spacer cord 70, and aperture 20 can be of any size, located anywhere on spacer support 5, additional apertures can exist on spacer support 5 or cords 65, 70 may be suitably attached, by clip, glue and/or the like, to any portion of the spacer support 5. Moreover, spacer support 5, or any portion of spacer support 5, may be formed around, and fused to, spacer cord 70 and/or lift cord 65, thereby eliminating the need for the aperture 20.

With particular reference to FIG. 2B, spacer support 5 preferably includes an elliptical notch 54 on the cylindrical end 25 which receives a plate 52. Notch 54 preferably includes a protruding, convex ridge along its inner circumference for receiving the side-slotted groove along the outer circumference of the side surface of plate 52. Plate 52 is preferably an elliptical device with a first rounded end with a flat upper and lower surface and a second enlarged cylindrical end 25 which tapers down on its outside edge, thereby forming an arrowhead like configuration. In a preferred embodiment, if a spacer cord 70 is used, plate 52 and cylindrical projection 53 (as discussed above) is molded around spacer cord 70 such that spacer cord 70 travels through the flat upper and lower surface of plate 52. One skilled in the art will appreciate that the plate 52 and notch 54 configuration can be any configuration and can include any suitable means for attaching plate 52 to spacer support 5 (groove, clip, etc.), or alternatively, spacer support 5 can be a one piece configuration without a removable plate 52.

More particularly, if it is desired that sheet material 60 lay flat without pleating or the like (for example, in the case of sheet material 60 comprising a detailed pattern), plate 52 and spacer cord 70 may be eliminated from the system. However, if pleating or the like is desired (for example, in the case of sheet material 60 comprising a solid color), the incorporation of plate 52 and spacer cord 70 into spacer support 5 helps form the pleats.

Figure 3:
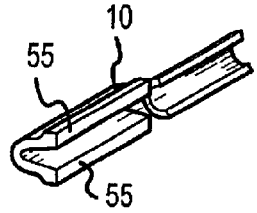
FIG. 3 is a three-quarter-perspective view of a portion of an exemplary rod according to one embodiment of the present invention.
Figure 6:
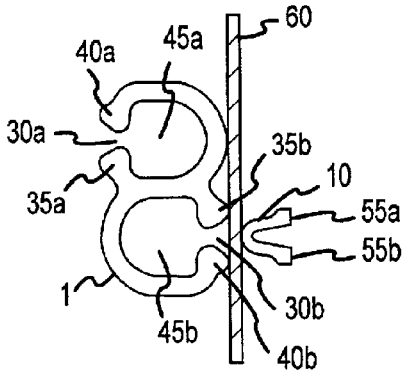
FIG. 6 is a side elevation view of an exemplary shade clamp prepared to receive a welting of sheet material for subsequent gripping with a rod according to one embodiment of the present invention.

Rod 10 is any device configured for securing sheet material 60 within the mounting channel 45*b* of the shade clamp 1. As best shown in FIG. 3 (which shows a portion of the elongated rod 10 in a V-spring clip embodiment), rod 10 is preferably one piece and has a length equal to the width of the shade. Alternatively, rod 10 is many clips, rods, or the like which are inserted into mounting channel 45*b* at various locations. Rod 10 is preferably a V-spring having depressible wings 55*a*, 55*b* for releasably securing a welting of the sheet material 60. As best shown in FIG. 6, the V-spring wings 55*a*, 55*b* are compressed to collapse the rod 10 for subsequent insertion into the mounting channel 45*b* through the mounting channel lateral opening 30*b*. After insertion into channel 45*b*, the rod 10 is released and the wings 55*a*, 55*b* expand to provide a force against the inner surface of channel 45*b*, thereby sandwiching the sheet material 60 in mounting channel 45*b* and restricting the movement of sheet material 60. Those skilled in the art will also recognize various other means and shapes that may be alternatively or conjunctively used which are within the scope of the present invention, such as, for example, a rod, a pin, clasp, VELCRO™, adhesive, snaps and/or the like. Alternatively, rod 10 could be eliminated and material 60 can be wrapped around the outside of mounting channel 45*b* and optionally clamped to the outside of mounting channel 45*b* by any of the aforementioned clamping devices.

Figure 5:
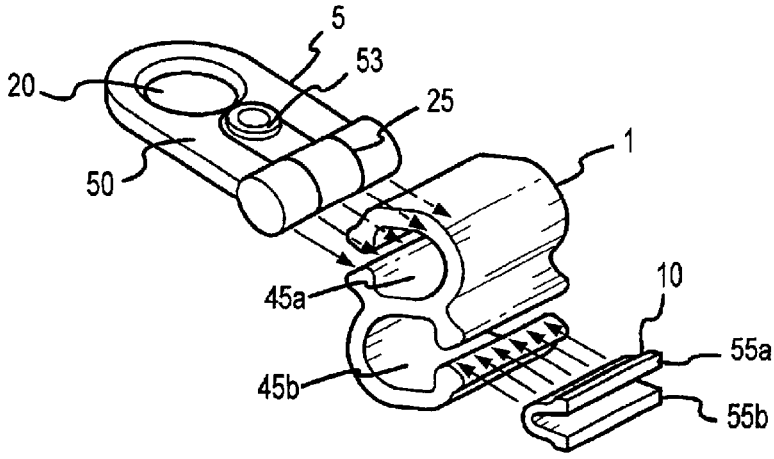
FIG. 5 is a three-quarter-perspective view with arrows depicting an exemplary method of receivably engaging a V-spring and spacer within opposed shade clamp channels according to one embodiment of the present invention.

The positional arrangement of the component parts of the sheet material mounting apparatus is best shown in FIG. 4. Spacer support 5 receivably engages through side insertion into spacer channel 45*a* of shade clamp 1 and the rod 10 receivably engages through side insertion the mounting channel 45*b* of the clamp 1. An alternative method of receivably engaging both the spacer support 5 and the rod 10 in their respective channels 45*a*, 45*b* is shown by the arrows of FIG. 5 wherein the components are pushed into their respective channels through openings 30*a*, 30*b*, respectively. Those skilled in the art will also recognize various other methods that may be alternatively or conjunctively used which are within the scope of the present invention, such as any arrangement or methods for receivably engaging, such as, for example, rotating the components into the channels, permanent single-piece construction and/or the like.

Figure 7:
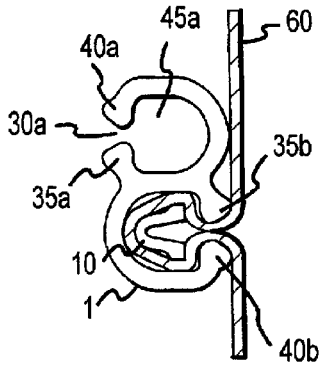
FIG. 7 is a side elevation view of an exemplary shade clamp having receivably engaged a V-spring and a welting of sheet material according to one embodiment of the present invention.

As is best shown in FIG. 6, prior to receivably engaging a welting of sheet material 60, the sheet material 60 is placed between the mounting channel 45*b* and the rod 10. As the upper wing 55*a* and lower wing 55*b* of the rod 10 are compressed, the rod 10 is pushed through the lateral opening 30*b* of the mounting channel 45*b* or slid through the side, forcing a welting of fabric 60 into the mounting channel 45*b* as shown in FIG. 7. Alternatively, a welting of sheet material 60 can be wrapped around the exterior surface of the rod 10 and then depressed and forced through the lateral opening 30*b* (or slid through the side).

With the guide spacer channel 45*a* opening the opposite direction to the sheet-material mounting channel 45*b*, the receivably engaged spacer support 5 is positioned to bear a large percentage of the weight of the sheet material 60 at a point approximately directly above the point of sheet material attachment within channel 45*b*. This configuration positions the center of gravity of the apparatus more directly above the mounting channel 45*b* which has the effect of reducing asymmetric tilting of the sheet-material mounting apparatus as the lift cord 70 is raised. This in turn reduces the friction incident upon the lift cord 70 as the shade travels through raised positions and reduces the pulling force needed to lift the shade.

Figure 8:
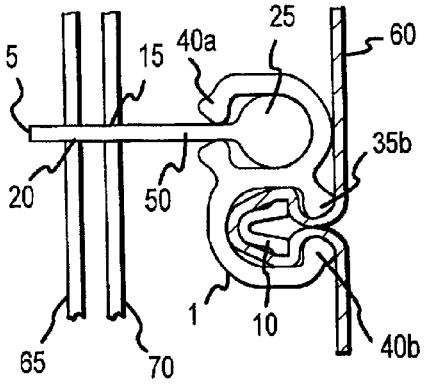
FIG. 8 is a side elevation view of an exemplary shade clamp attached to a support structure and having receivably engaged a V-spring, a welting of sheet material and a spacer, wherein the spacer includes a lift cord and spacer cord, according to one embodiment of the present invention.

One method of attachment of clamp 1 to the support structure of a lift cord 65 and spacer cord 70 is shown in FIG. 8. As the lift cord 65 is raised, the spacer support 5 is engaged at a predetermined point to raise and travel with the lift cord 65. The spacer cord 70 is a static line that provides a guide for a plurality of spacer supports 5 to travel along as the shade is moved through raised positions. The spacer cord 70 also assists with preventing torquing of the spacer supports 5 as the lift cord 65 is raised.

Figure 9:
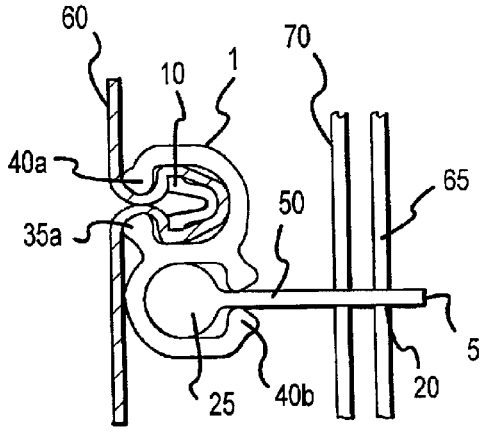
FIG. 9 is a side elevation view of an exemplary shade clamp attached to a support structure and having receivably engaged a v-spring, a welting of fabric and a spacer, wherein the spacer includes a lift cord and spacer cord, according to an alternative embodiment of the present invention.
Figure 10:
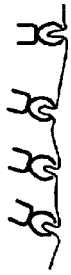
PRIOR ART FIG.10
FIG. 10 is a side view of a prior art device showing the asymmetric tilting of the gripping devices.

FIG. 9 shows an alternative configuration for reducing friction incident upon the lift cord 70. In this alternative embodiment of the present invention, the receivably engaged spacer support 5 is positioned to bear the weight of the sheet material 60 at a point directly below the point of sheet material attachment to mounting channel 45*b*. This configuration positions the center of gravity of the apparatus more directly below the mounting channel 45*b* which similarly has the effect of reducing asymmetric tilting of the sheet-material mounting apparatus as the lift cord 65 is raised. The alternative embodiment of the present invention depicted in FIG. 9 reduces the friction incident upon the lift cord 65 as the shade travels through raised positions as well.

Figure 11C:
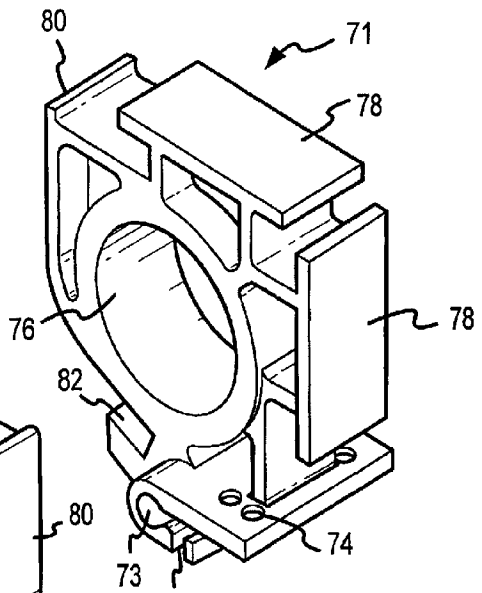
FIG. 11C is a rear view of a center support bracket according to one embodiment of the present invention.
Figure 11B:
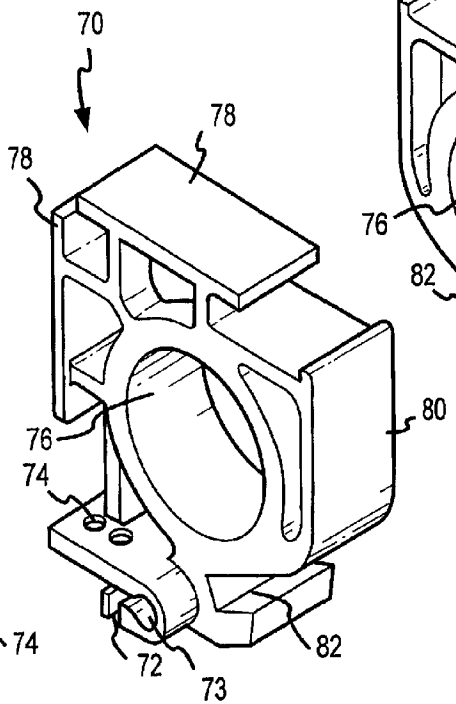
FIG. 11B is a front view of a center support bracket according to one embodiment of the present invention.
Figure 11A:
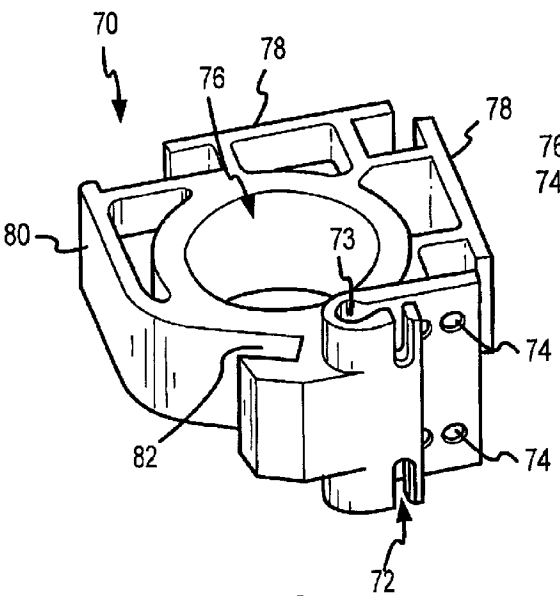
FIG. 11A is a bottom view of a center support bracket according to one embodiment of the present invention.

With respect to FIGS. 11A-C, various views of a center support bracket 71 is shown. Center support bracket 71 is any suitable device configured to support the lift tube 112 (shown in FIG. 13), housing 90, facie 110 (shown in FIG. 13), spacer support 5, and fabric mount while providing a guide for the lift cords 65. One skilled in the art will appreciate that bracket 71 is of any configuration and comprised of any suitable material. Moreover, bracket 71 can be one molded multi-functional component or can be a plurality of components which perform one or more of the aforementioned functions. In a preferred embodiment, bracket 71 includes a central circular opening 76 for supporting the lift tube 112. Top and rear rectangular plates 78 are attached to opening 76 by a lattice structure which is perpendicular to the surface of opening 76. Rectangular plates 78 include lips around its periphery such that plates 78 are suitably configured to attach bracket 71 to housing 90 by slidably engaging the lips into channels 94. The front of bracket 71, as best seen in FIG. 11B, preferably includes a rectangular facie plate 80 with a lip on its periphery for slidably engaging facie. One skilled in the art will appreciate that plates 78 and 80 can attach to other parts by any suitable means, including for example, snaps, VELCRO™, adhesives and/or the like, or can be integral with the other components. Below plate 80, towards the bottom of bracket 71, is an angled ledge 82 which is configured to support the fabric mounting spline. In one exemplary embodiment, the sheet material may be wrapped around the fabric mounting spline 60 and secured to the spline using an adhesive, staples, tacks, nails, VELCRO™, snaps and/or any such means suitable for such securing. Once the sheet material is affixed, the spline may be mounted securely in the angled ledge 82. In one embodiment, the spline may be secured by inserting the spline including the sheet material 60 into the angled ledge and mounting the facie 110 to the bracket 71. As best seen in FIG. 11A, below ledge 82, and on the bottom of bracket 71, are two opposing notches 72 which open to the outside surfaces of bracket 71 and a circular slot 73. Notches 72 and slot 73 are suitably configured to retain spacer support 5. Also, in an exemplary embodiment, on the bottom of bracket 71 and further towards the rear surface, there may be included four apertures 74 and 75. Aperture 74 may be suitably configured to guide the lift cord 65 during the raising and lowering of the sheet material 60.

Figure 12:
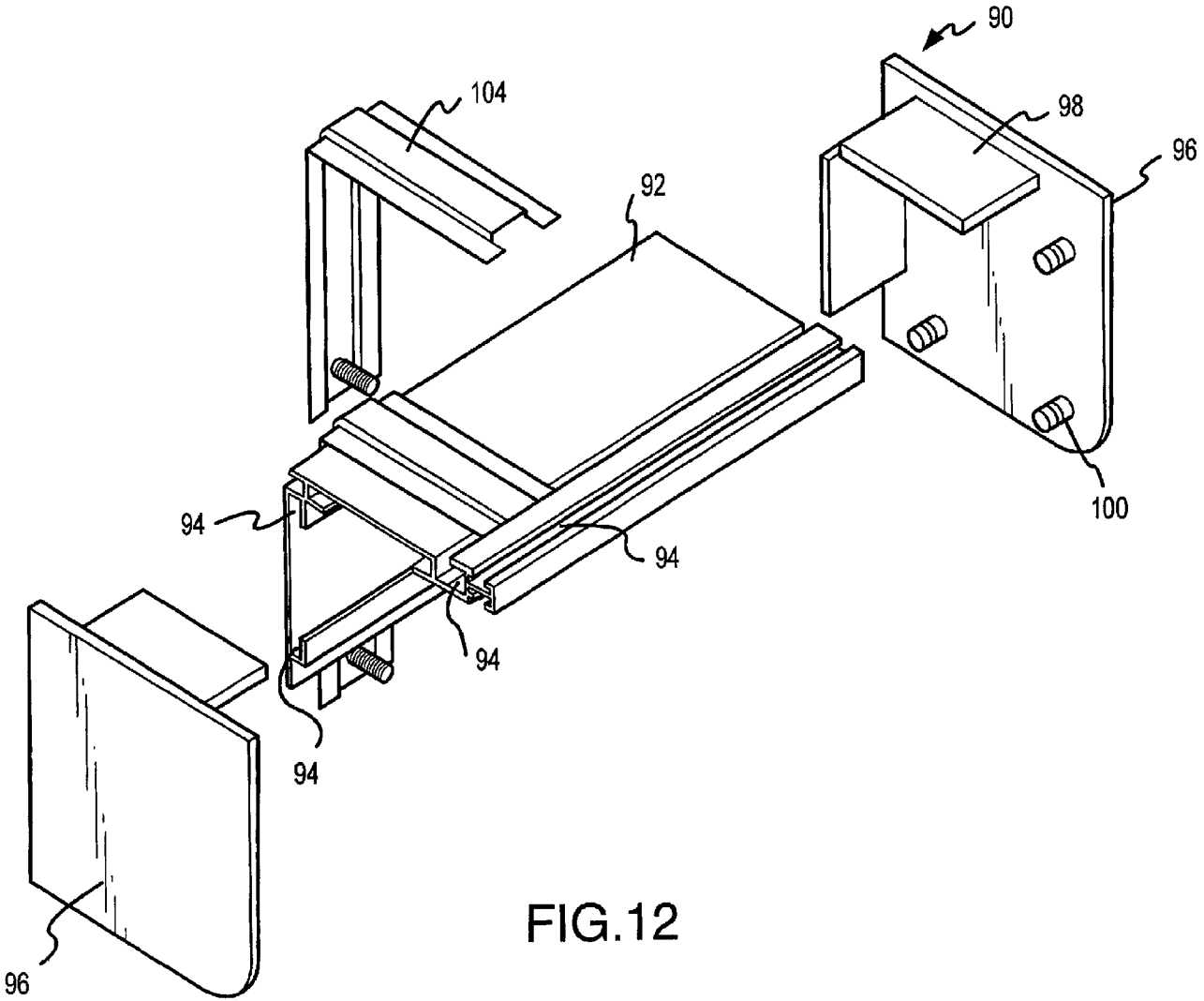
FIG. 12 is an exploded view of the housing assembly showing the end caps and wall brackets according to one embodiment of the present invention.
Figure 13:
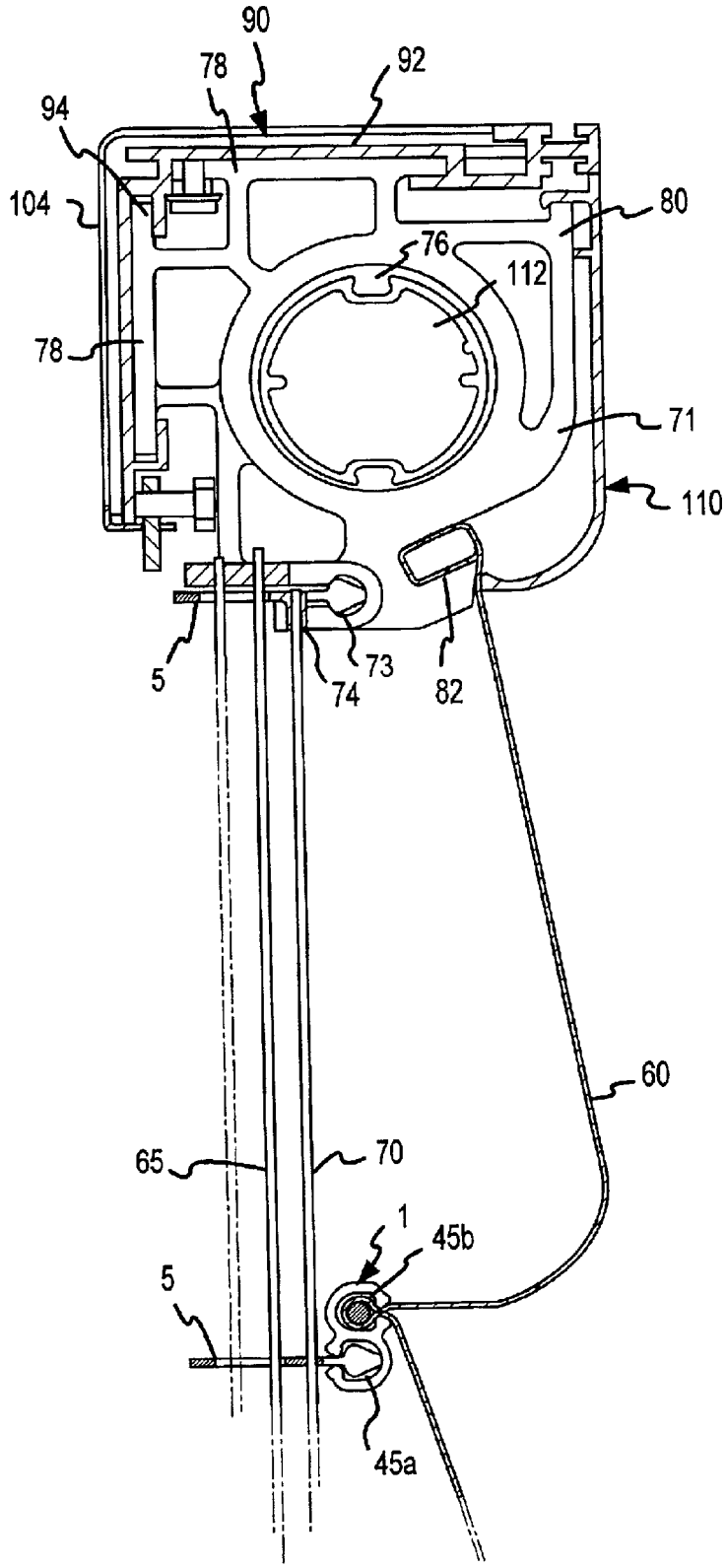
FIG. 13 is a side cut-away view of a support assembly showing a center support bracket, housing and shade clamp according to one embodiment of the present invention.

With respect to FIG. 12, an exemplary housing assembly 90 is shown. Housing assembly 90 is any suitable device or combination of devices in any suitable configuration for supporting center bracket 71 and facie 110 and comprised of any suitable material such as plastic, PVC, metal, aluminum, wood, and/or the like. In a preferred embodiment, housing 90 includes L-shaped plate 92 comprised of extruded aluminum, end caps 96 comprised of plastic, and wall brackets 104 comprised of metal. Plate 92 includes various channels 94 for slidably engaging plates 78 and 80 of center bracket 71, wall bracket 104, and plates 98 of end caps 96. End caps 96 preferably include plates 98 for slidably engaging plate 92 and pins 100 for attaching to the shade drive end bracket.

Figure 14A:
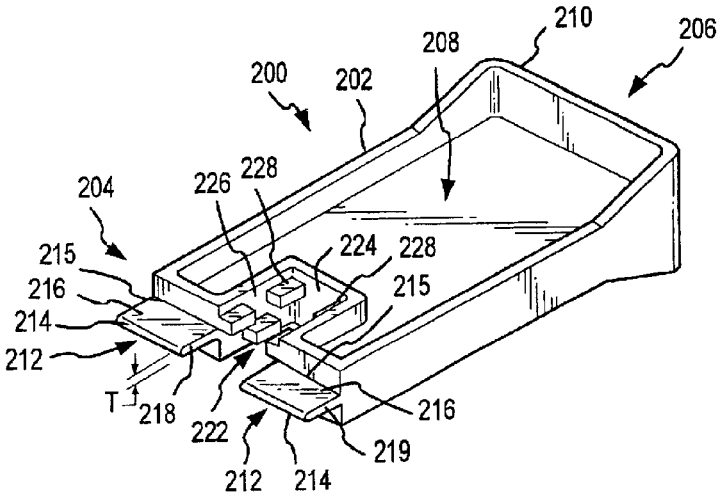
FIGS. 14A-E illustrate a side perspective view of an exemplary tool for assembling and aligning the components of a sheet material mounting device.

In accordance with another exemplary aspect of the present invention, FIGS. 14A-E illustrate an exemplary insertion tool 200. Insertion tool 200 may be used for assembling components of a sheet material mounting device, such as shade clamp 201 and spacer support 205. However, it will be appreciated that insertion tool 200 may be used in any of several contexts. For example, insertion tool 200 may be used to insert or assemble hardware components within an opening in a wall or similar structure. Insertion tool 200 may also be configured for use with components used in microdevices, such as integrated circuits. Referring now to FIG. 14A, in accordance with one exemplary embodiment, tool 200 comprises a base member 202 having a working end 204 and a handle end 206. One skilled in the art will appreciate that tool 200 may be comprised of any suitable material or combinations of materials, such as, for example, plastic, metal, wood, concrete, rock, and/or the like. In an exemplary embodiment, tool 200 is molded of Delrin. Moreover, tool 200 may be comprised of a single molded, shaped, or formed unit, or it may comprise any number of pieces permanently or releasably attached to each other.

In accordance with one aspect of the invention, handle end 206 is configured to be gripped by the hand of a person, though other embodiments of handle 206 may permit use of tool 200 by a machine or automated device. In one embodiment, handle end 206 permits insertion of a hand through an open center portion 208 and around handle portion 210. Handle portion 210 may comprise any suitable surface contour or configuration, such as rounded or bulbous, cylindrical, rectangular, conical, and/or the like. In another embodiment, center portion 208 is a solid portion which permits handle end 206 to be grasped in the palm of the hand. For example, in this embodiment, handle portion 210 may be held by being pressed against the palm of the hand while the fingers of the hand grasp one side of center portion 208 and the thumb grasps an opposite side of center portion 208. Handle end 206 may be of any suitable dimension or size. In one embodiment, handle end 206 is thicker than working end 204 to suitably accommodate the grip or grasp of a human hand, a machine, or an automated device.

Figure 14B:
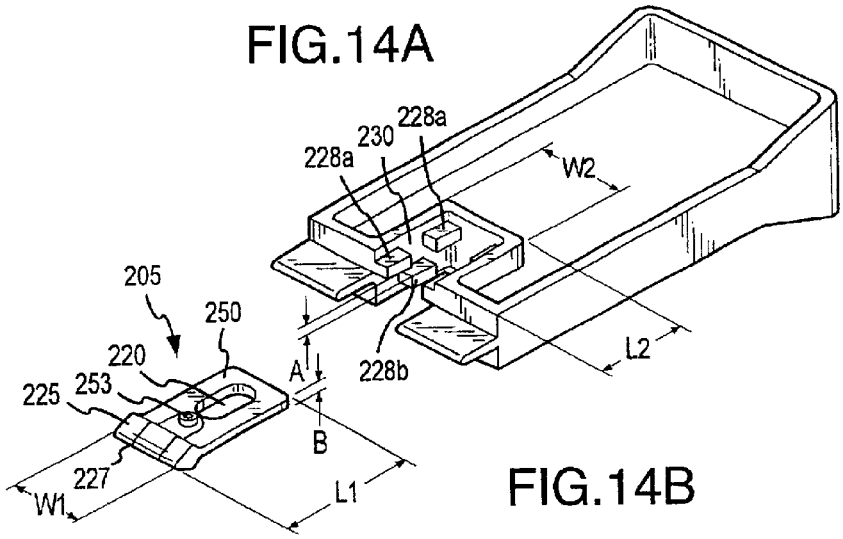

Working end 204 is distal from the handle end 206 and is configured to receivably engage and releasably retain a part or component, such as spacer support 205, such that working end 204 and the component are then capable of being inserted into and receivably engaged by an opening, such as spacer channel 245*a* for example. As described herein, the insertion of a component into a spacer channel illustrates an exemplary use for and method of using tool 200 in accordance with the present invention. However, tool 200 may be used to insert and adjust or align parts or components in conjunction with other types of openings, channels, or holes having a variety of shapes or configurations, such as circular, rectangular, square, oblong, triangular, etc., and still fall within the scope of the present invention. In one embodiment, working end 204 includes a pair of spaced apart protruding members 212 which are each configured to be inserted into or slid through the spacer channel 245*a* of shade clamp 201, as best illustrated in FIG. 14D. The protruding members 212 extend outwardly from the working end 204 of base member 202 and may be of any suitable shape or configuration, such as rectangular, cylindrical, conical, square, and/or the like.

In one embodiment, protruding members 212 are substantially rectangular. In this embodiment, the protruding members 212 each comprise an outer edge 214, an inner edge 215, an upper surface 216, a lower surface (not shown), an inner side surface 218, and an outer side surface 219. In one embodiment, outer edge 214 has a rounded surface. In another embodiment, upper surface 216 is gradually sloped upward relative to a level lower surface, such that thickness T of protruding member 212 gradually increases along the width of protruding member 212 between outer edge 214 and inner edge 215. In one embodiment, upper surface 216 is gradually sloped upward at an angle ranging from about 2 degrees to about 15 degrees relative to the lower surface and the longitudinal axis of the base member 202. Preferably, upper surface 216 is sloped upward at an angle of from about 3 degrees to about 7 degrees and, more preferably, from about 3 degrees to about 4 degrees. In another embodiment, the lower surface (not shown) of the protruding member 212 is gradually sloped downward relative to a level upper surface 216, such that thickness T of protruding member 212 gradually increases along the width of protruding member 212 between outer edge 214 and inner edge 215. In this embodiment, the lower surface is gradually sloped at an angle ranging from about 2 degrees to about 15 degrees relative to the upper surface 216 and the longitudinal axis of the base member 202. Preferably, the lower surface is sloped at an angle of from about 3 degrees to about 7 degrees and, more preferably, from about 3 degrees to about 4 degrees. In yet another embodiment, both the upper surface 216 and the lower surface of protruding member 212 are gradually sloped away from each other and relative to the longitudinal axis of the base member 202 such that each protruding member 212 has a substantially conical configuration.

In an exemplary embodiment, protruding members 212 are spaced apart by a recess 222 in the working end 204 of base member 202. Recess 222 may be of any suitable shape or configuration, such as square, rectangular, semi-circular, and/or the like. In one embodiment, a rear surface 224 and a pair of opposing side surfaces 226 in the working end 204 define recess 222. In an exemplary embodiment, opposing side surfaces 226 each include means for engaging and retaining a spacer support 205, which means may include a plurality of retaining members adapted to support the spacer support 205 within recess 222, a suitably dimensioned channel or track which may be inset into each of the opposing side surfaces 222 and into which the spacer support 205 may be inserted, or the like. In an alternate embodiment, rear surface 224 may also include suitable means for releasably retaining spacer support 205, such as retaining members or a suitably dimensioned inset channel or track. Recess 222 and the means for engaging and retaining spacer support 205 are suitably adapted to releasably engage the spacer support 205.

In one embodiment, the means for engaging and retaining a spacer support 205 comprise a plurality of retaining members 228 extending from each of the opposing side surfaces 226. The retaining members 228 may be arranged in any suitable configuration capable of receivably engaging and retaining the spacer support 205 within recess 222. As illustrated in FIG. 14B, retaining members 228 may be arranged in a V-shaped configuration such that a pair of spaced apart upper retaining members 228*a* are coupled with a lower retaining member 228*b* which is placed beneath the space 230 that separates the pair of upper retaining members 228*a*. A space or track having height H2 is created between upper retaining members 228*a* and lower retaining member 228*b*. Height H2 is slightly greater than the thickness H1 of spacer support 205. In this manner, the spaces or tracks created by the opposing side surfaces 226 may stabilize and retain the spacer support 205 within the recess 222, such that when spacer support 205 is inserted within the recess 222, an upper portion, such as that provided by the retaining members 228*a*, exerts a downward force on spacer support 205 while a lower portion, such as provided by retaining member 228*b*, exerts an upward force on spacer support 205. Alternatively, retaining members 228 may be arranged such that a pair of spaced apart upper retaining members is coupled with a spaced apart pair of lower retaining members. In a further embodiment, retaining members 228 may be adapted such that a single upper retaining member on each of the opposing sides 226 is coupled with a single lower retaining member on each of the opposing sides 226 to suitably engage and retain spacer support 205 within recess 222. Recess 222 and retaining members 228 are suitably dimensioned to permit spacer support 205 to be slidably inserted within and removed from the recess 222. In one embodiment, recess 222 has a width W2 that is slightly greater than a width W1 of spacer support 205 and a length L2 that is substantially similar to a length L1 of spacer support 205. One skilled in the art will appreciate that retaining members 228 illustrate an exemplary means for engaging and retaining a spacer support 205 within recess 222 in accordance with the present invention and that other structures, such as an inset track or channel within each of opposing side surfaces 226, which perform similar functions may be employed and still fall within the scope of the present invention.

Figure 14C:
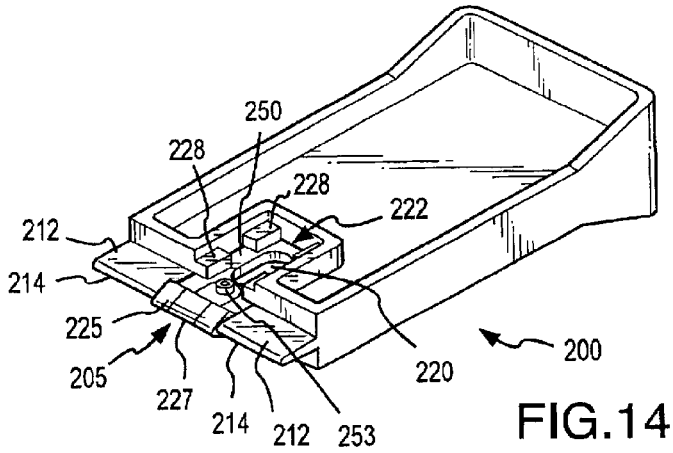
Figure 14D:
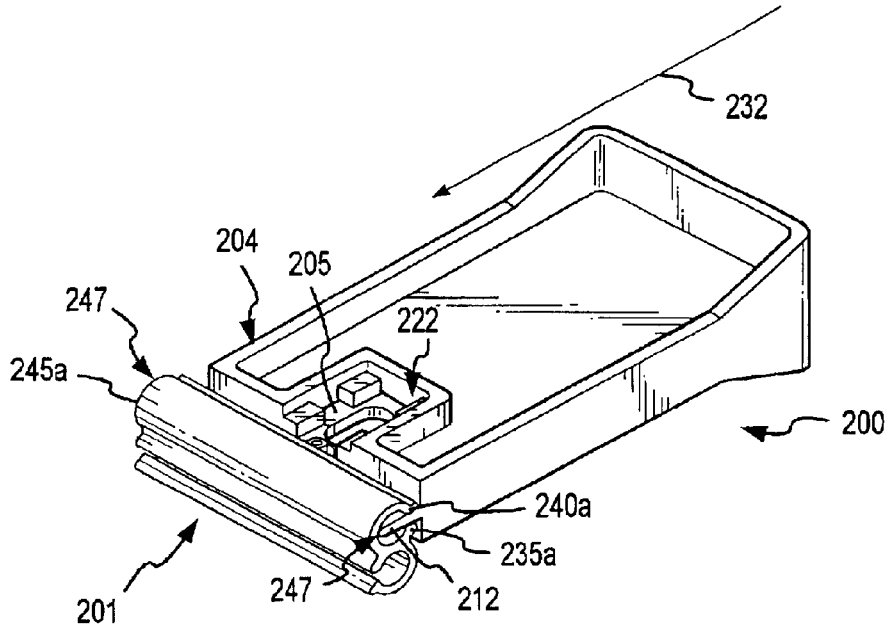
Figure 14E:
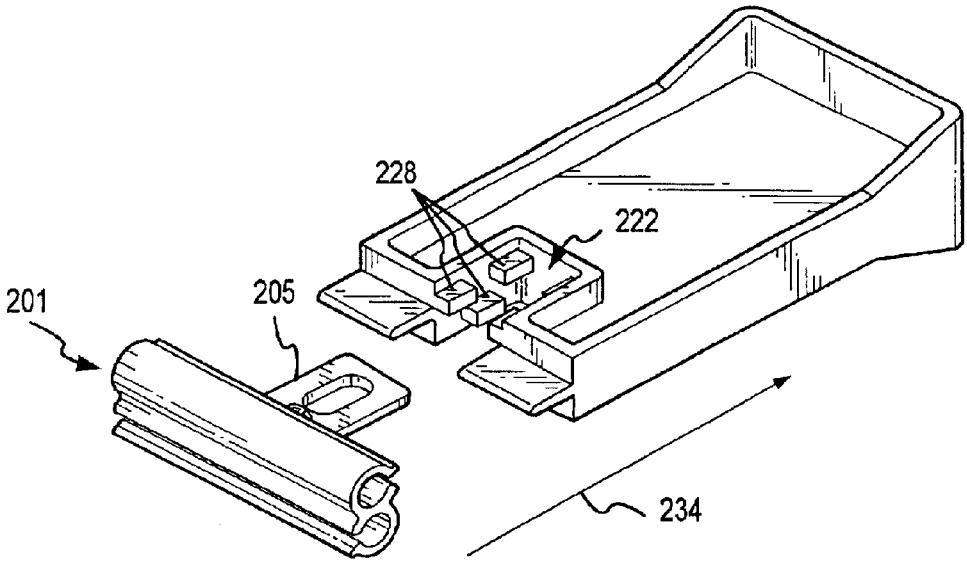

As seen in FIG. 14C, spacer support 205 may be inserted within recess 222 such that planar flange 250 is supported by retaining members 228 and cylindrical end 225 occupies the space between the protruding members 212. In one embodiment, the outer edge 227 of cylindrical end 225 is substantially flush with the outer edges 214 of protruding members 212. Spacer support 205 may be inserted into the tool 200 either with or without a spacer cord (not shown) being inserted through cylindrical projection 253 and/or a lift cord (not shown) being inserted through lift cord aperture 220.

Referring next to FIG. 14D, tool 200, with spacer support 205 retained within recess 222, can be used to insert spacer support 205 within spacer channel 245*a* of shade clamp 201. In one embodiment, one of the protruding members 212 of the working end 204 of tool 200 is brought into contact with a spacer channel end 247 and is inserted or slid into spacer channel 245*a* between peripheral lip 240*a* and inner lip 235*a*. In this embodiment, the protruding member 212 may be used to open or slightly pry apart the lips 240*a* and 235*a* at one end 247 of the spacer channel 245*a*, such that a first protruding member 212 slides into the spacer channel 245*a*, followed by spacer support 205 and then a second protruding member 212.

Alternatively, the working end 204 of tool 200 with spacer support 205 retained within recess 222 may be brought into contact with the spacer channel 245*a* such that the protruding members 212 and the spacer support 205 exert a perpendicular force in the direction of arrow 232 against lips 240*a* and 235*a*. As one skilled in the art will appreciate, in the context of using tool 200 with other types of openings and other types of parts or components, the working end 204 of tool 200 may be brought into contact with the outer edges of the opening, such that the protruding members 212 and the component exert a perpendicular force against the outer edges of the opening to enable the tool 200 and the component to be inserted into the opening. The tool 200 may be inserted into an opening with or without the aid of an additional tool, such as a hammer or mallet for example (not shown). In the embodiment depicted in FIG. 14D, the working end 204 of the tool 200 may be used to insert the spacer support 205 substantially at the desired location or position within the spacer channel 245*a*. That is, protruding members 212 are used substantially simultaneously to open or pry apart lips 240*a* and 235*a* at a selected location along spacer channel 245*a* to permit the insertion of the protruding members 212 and spacer support 205 into the spacer channel 245*a*. However, in either of these embodiments, once inserted within the spacer channel 245*a*, tool 200 permits the spacer support 205 to be suitably moved or selectively positioned within spacer channel 245*a*. Thus, tool 200 may be used to selectively position spacer support 205 within the spacer channel 245*a* during the insertion step or, alternatively, the tool 200 may be used to selectively position spacer support 205 anywhere along the length of spacer channel 245*a* subsequent to the insertion step. Moreover, tool 200 may be used consecutively to similarly insert and position multiple spacer supports 205 within spacer channel 245*a*.

Once spacer support 205 has been suitably positioned within spacer channel 245*a*, the tool 200 may be suitably removed from the spacer channel 245*a*. In one embodiment, tool 200 is removed by the exertion of a force on tool 200 that is perpendicular to and away from the spacer channel 245*a*. In this manner, the tool 200 is pulled directly out of and away from the spacer channel 245*a* in the direction of arrow 234 of FIG. 14E. As further illustrated in FIG. 14E, since recess 222 and retaining members 228 are adapted to releasably engage spacer support 205, spacer support 205 remains suitably positioned within spacer channel 245*a* when tool 200 is removed from the spacer channel 245*a*.

Once a part or component has been inserted into the appropriate opening, such as spacer channel 245*a*, the component may require adjustment or re-alignment with respect to other components of the window covering system. The tool 200 also may be used to adjust or re-align these already-assembled components. The tool 200 provides leverage and a gripping surface to assist in shifting the arrangement of assembled components. To accomplish this, the tool 200 is extended into the opening and brought into contact with the component such that the component is retained by the working end 204 and capable of being moved by the tool 200 to an alternate position within the channel or opening without being bound by the opening. In this manner, the tool 200 permits adjustment and realignment of tightly fitting assembled components.

Figure 15A:
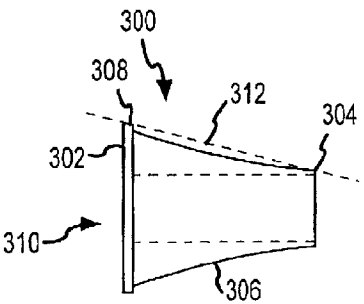
Figure 15B:
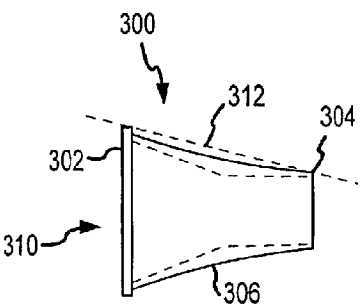

FIGS. 15A-D depict exemplary embodiments of a lifting sleeve 300 which may be used with the present invention. As shown in FIG. 15A, lifting sleeve 300 may be cylindrical in shape, and may include a circular proximal end 302 (shown in FIG. 15C) and a circular distal end 304 (shown in FIG. 15D), where the outer diameter of the proximal end 302 may be greater than the outer diameter of the distal end 304. Lifting sleeve 300 may further include an open passageway 310. The passageway 310 may be formed from the proximal end 302 to the distal end 304, or alternatively, the passageway 310 may be formed partially from the distal end 304 terminating within the body of sleeve 300. In one exemplary embodiment, the passageway 310 may be of constant diameter from the proximal end 302 to the distal end 304. In another exemplary embodiment of the lifting sleeve 300 shown in FIG. 15B, passageway 112 may be tapered along a portion of the passageway 312 length. Such tapering may include the diameter of the passageway 310 at the proximal end 302 being different from the diameter at the distal end 304. In either configuration, the diameter of the passageway 310 at its distal end 304 may be such that the open passageway 310 permits the partial or full insertion of a lift tube 112 (shown in FIG. 16). In this context, lifting sleeve 300 may be suitably configured to surround at least a portion of the circumference of the lift tube 112. Lifting sleeve 300 may be configured to freely rotate during operation of the support structure.

The proximal end 302 of lifting sleeve 300 may be further configured such that the proximal end 302 may abut, mate with, engage or lie flush against the opening 76 of support bracket 71. As shown in FIG. 16, when abutting against opening 76, the lifting sleeve 300 and the opening 76 may permit the partial or full insertion of lifting tube 112 into the passageway 310 and/or partially or fully into the opening 76. In addition, lifting sleeve 300 may be aligned against opening 76 such that lift cord 65 may be guided onto the proximal end 302. Further included on the proximal end 302 of sleeve 300 may be a shoulder 308 for ensuring that the lift cord 65 remains engaged with an outer surface 306 of the lifting sleeve 300, where the outer surface 306 extends from the shoulder 308 to the distal end 304. In this arrangement, the first winding is made to abut against the surface of the shoulder 308 nearest the distal end 304 of the sleeve. That is, the shoulder 308 may be configured such that the shoulder 308 is positioned against the support bracket 71 preventing the cord 65 from lodging between the support bracket 71 and lifting sleeve 300. More particularly, the portion of the lift cord 65, traversing from aperture 74 to the outer surface 306, may be permitted to engage the surface 306 of lifting sleeve 300 tangentially.

In an exemplary embodiment, outer surface 306 of the lifting sleeve 300 forms a continuous uninterrupted surface. More particularly, the contour of surface 306 forms a continuous arc (e.g., circle segment) of suitable radius, wherein the chord 312 of the arc may be drawn from the shoulder 308 to the lifting sleeve distal end 304.

It should be noted that although an exemplary embodiment of the present invention is described with respect to a first and second winding, it should be understood that the first and second winding may represent any numbered winding which includes successively wound cords. Thus, the use of first winding and second winding is done for illustrative purposes only.

During operation, a first winding of lift cord 65 may traverse the circumference of the lifting sleeve 300 at the sleeve proximal end 302 on the side of shoulder 308 nearest the distal end 304. The cords are lifted uniformly, in order to lift the sheet material 60 while keeping the bottom of the sheet material absolutely parallel with the horizontal. As the shade sheet material 60 is raised from a lowered position, additional windings of lift cord 65 may further engage the lifting sleeve in similar fashion as is described above with respect to a first winding. The first winding may experience moving forces resulting from the tangential and perpendicular force components of gravity, which may cause the first winding to move from its position abutting the shoulder 308 and move closer to the distal end 304 of the sleeve 300. That is, as the sleeve 300 rotates about its central axis, a second winding of cord 65 may seek to stack on the first winding of cord 65. The weight of shade material 60 causes the second winding to exert at least a substantially downward contact force as well as a substantially tangential force on the first winding. The tangential force being exerted by the first winding may be directed from the shoulder of sleeve 300 and may be substantially tangential to the portion of the arc surface 306 with which the first winding is in contact. In this manner, the combination of the downward and tangential forces exerted by the second winding causes the first winding to move from its position near the shoulder 308 and traverse in a direction down the surface 306 toward the distal end of the sleeve 300. This process is repeated as additional winding engage the lifting sleeve 300 permitting the lift cord 65 to be raised at any desired distance. Once raised, the lift cord 65 may be positioned on sleeve 300 in a substantially unstacked fashion.

During the lowering of the shade material 60, the sleeve 300 may rotate in a direction opposite the rotational direction experienced by the sleeve 300 during the raising of the material 60. That is, the cord 65 may be unwound from the sleeve 300 as the shade material is lowered to any desired position. As the sleeve 300 is rotated, the second winding may be guided from the sleeve surface 306 to the aperture 74. The movement of the first winding may substantially facilitate the traversal of the first winding into a position nearer to and/or abutting sleeve shoulder 308. With continued winding of the sleeve 300 the first winding may be guided from surface 306 to aperture 74, in similar manner as is described with respect to the second winding, permitting the cord 65 to be in a substantially unwound position.

While the invention has been particularly shown and described above with reference to exemplary embodiments, it will be understood by those skilled in the art that various changes in form and detail may be made without departing from the spirit and the scope of the present invention and that the invention encompasses all such modifications. No single feature, function, or property of any disclosed embodiment is required for the practice of the present invention unless specifically described herein as "essential" or "critical."

What is claimed is:

1. A system for winding a lift cord comprising:

at least a first support bracket and a second support bracket configured to support a lift tube which receives a first lifting sleeve and a second lifting sleeve, said first and second support brackets including a lift cord guide;

a first and second lift cord;

a first and second lifting sleeve, said first and second lifting sleeve comprising a first end, a second end, a shoulder positioned circumferentially about said first end, a contour surface extending from said first end to said second end, said contour surface forming a concave arcuate continuous surface, said first lift cord being guided by said first lift cord guide onto said first lifting sleeve, said second lift cord being guided by said second lift cord guide onto said second lifting sleeve;

a lift tube, said lift tube configured to uniformly wind said first lift cord onto said first lifting sleeve, and said second lift cord onto said second lifting sleeve; and, a lift tube support bracket including:

an opening for supporting a lift tube;

a top rectangular plate positioned substantially tangential to said opening;

a rear rectangular plate positioned substantially tangential to said opening, said rectangular plate substantially perpendicular to said top rectangular plate;

an angled ledge configured to support a fabric mounting spine, said angled ledge including at least one of a first ledge wall, a second ledge wall, and a third ledge wall; and a clamp for receiving a spacer support, said clamp positioned opposite said angled ledge, said clamp including a clamp opening along a portion of said clamp, said clamp opening configured to receive said spacer support, said clamp opening including an upper plate and a lower plate.

2. A system for winding a lift cord comprising:

a support bracket, said support bracket comprising an opening configured to support a lift tube, at least one of a top and rear rectangular plate including protrusions for slidably engaging a bracket housing, an angled ledge including at least one of a first ledge wall, second ledge wall, and a third ledge wall, a clamp for removably receiving a spacer support, said clamp including a clamp opening along a portion of said clamp, said clamp opening including an upper plate and a lower plate, said upper plate including an aperture for guiding a lift cord; and a lifting sleeve positioned in abutment to said central circular opening.

3. A method for winding a lift cord, including the steps of:

providing a support bracket including an angled ledge configured to support a fabric mounting spline, a clamp for removably receiving a support spacer, the clamp including an upper plate with aperture for guiding a lift cord;

abuting the support bracket against a lifting sleeve, the lifting sleeve including a first end with a circumferentially positioned shoulder, a second end of lesser circumference than the first end, and a contour surface forming a concave arcuate continuous surface from the first end to the second end;

aligning the aperature to the portion of the lifting sleeve nearest the circumferentially positioned shoulder;

affixing a lift cord to the contour surface wherein the lift cord abuts the portion of the shoulder nearest the second end;

guiding the lift cord from the aperture to the contour surface;

winding the lift cord onto the lifting sleeve permitting the lift cord to form a first winding, wherein the first winding abuts the portion of the shoulder nearest the second circular end;

winding the lift cord onto the lifting sleeve permitting the lift cord to form a second winding, the second winding exerting at least a tangential-force on the first winding, the tangential force being directed from the circumferential shoulder and tangential to the contour surface, the tangential force contributing to the movement of the first winding nearer to the second end permitting the second winding to lie flush against the contour surface.

4. A method according to claim 3 further including the steps of winding the second winding from the contour surface, the second winding being guided from the contour surface to the aperture, permitting the first winding to abut against a portion of the circumferential shoulder.

* * * * *